US008708157B2

(12) United States Patent
Gibson

(10) Patent No.: US 8,708,157 B2
(45) Date of Patent: Apr. 29, 2014

(54) MATERIAL SORTER

(76) Inventor: Travis Gibson, Mesa, AZ (US)

( * ) Notice: Subject to any disclaimer, the term of this patent is extended or adjusted under 35 U.S.C. 154(b) by 0 days.

(21) Appl. No.: 13/591,428

(22) Filed: Aug. 22, 2012

(65) Prior Publication Data

US 2013/0048544 A1 Feb. 28, 2013

Related U.S. Application Data

(60) Provisional application No. 61/526,261, filed on Aug. 22, 2011.

(51) Int. Cl.
*B07C 5/00* (2006.01)

(52) U.S. Cl.
USPC ..... 209/657; 209/640; 209/638; 209/696; 209/656

(58) Field of Classification Search
USPC ..... 209/635, 637, 638, 640, 696, 631, 656, 209/657, 263, 266
See application file for complete search history.

(56) References Cited

U.S. PATENT DOCUMENTS

| | | | | | |
|---|---|---|---|---|---|
| 291,123 | A | * | 1/1884 | Ziegler | 209/637 |
| 839,387 | A | * | 12/1906 | Hughes et al. | 209/696 |
| 865,301 | A | * | 9/1907 | Hague | 209/640 |
| 895,889 | A | * | 8/1908 | Pardee | 209/638 |
| 949,247 | A | * | 2/1910 | Pollock | 209/696 |
| 2,076,861 | A | * | 4/1937 | Parsons | 73/863.41 |
| 3,876,074 | A | * | 4/1975 | Douglas et al. | 209/696 |
| 3,955,680 | A | * | 5/1976 | Botula | 209/696 |
| 3,978,986 | A | * | 9/1976 | Schmidt et al. | 209/692 |
| 4,348,910 | A | * | 9/1982 | Johnson | 73/863.51 |
| 4,662,522 | A | * | 5/1987 | Kokubun et al. | 209/656 |
| 6,755,307 | B1 | * | 6/2004 | Kohl | 209/264 |

* cited by examiner

*Primary Examiner* — Kaitlin Joerger
(74) *Attorney, Agent, or Firm* — Keith L. Jenkins, Registered Patent Attorney LLC; Keith L. Jenkins

(57) ABSTRACT

A material sorter using guide rails of various configurations on an inclined panel to assist in sorting mixed density materials into higher density and lower density piles. In some embodiments, the guide rails may be repositioned via actuators or manually to adapt to requirements for different types of mixed-density materials to be sorted. The guide rails may be fixed in various discrete positions. Combinations of diverging and converging guide rails are used in some embodiments. Arrangements of multiple material sorters, each configured for different types of mixed-density materials, are disclosed.

20 Claims, 6 Drawing Sheets

MATERIAL SORTER

RELATED APPLICATIONS

This application claims the benefit of U.S. provisional patent application Ser. No. 61/526,261 filed Aug. 22, 2011 by the same inventor.

TECHNICAL FIELD

The present invention generally relates to material sorters, and more particularly relates to an apparatus for sorting mixed-density materials.

BACKGROUND

In pursuit of a green economy, progressively more intensive recycling efforts are being undertaken. In separating construction debris to obtain cardboard from a debris mixture including wood and cardboard, for example, hand-sorting operations are required that can consume four hours per truckload of mixed-density material. The sorting is required because the machinery used to recycle cardboard is susceptible to damage from wood. Similar sorting problems arise with other types of mixed-density materials.

The present inventor, who has significant experience in material sorting, began work on developing a solution for speeding up the sorting process in February of 2009. What follows is the result of his efforts.

Accordingly, it is desirable to speed up the separation of mixed density materials. In addition, it is desirable to speed up any separation operation that involves separating a denser material from a less dense material. In addition, it is desirable to provide an apparatus for those purposes. In addition, it is desirable to have the apparatus be of economical design and easy to operate. Furthermore, other desirable features and characteristics of the present invention will become apparent from the subsequent detailed description, taken in conjunction with the accompanying drawings and the foregoing technical field and background.

The present invention has been tested and shown to reduce sorting time to about twenty minutes per truckload of mixed-density material. This reduction by a factor of more than ten is worth tens of millions of dollars annually to large processors of mixed-density material. The cost of applicant's invention is trivial compared to the cost of conveyor sorters. The floor space taken up by applicant's invention is trivial compared to the floor space taken up by conveyor sorters.

BRIEF SUMMARY

An apparatus is provided for assisting in sorting of dry mixed-density material into more dense and less dense piles. One of embodiment of the apparatus comprises a inclined panel having converging and diverging guide rail pairs in which mixed-density material is deposited at the top to the incline and then slides down the incline, impacting the guide rails during descent. The less dense material is slowed and directed in its descent by contact with the guide rails to a greater extent than the more dense material, resulting in separation of the more and less dense materials. In an embodiment in which the top guide rails are converging and the lower guide rails are diverging, the more dense material tends to be dropped at the bottom of the incline directly below the point at which the debris was deposited, and the lighter material, being more susceptible to the force of the diverging guide rails is dropped to the sides. The apparatus has specific applicability to sorting cardboard from wood in construction debris and general applicability to sorting other combinations of materials of significantly different densities.

A method is provided for sorting mixed-density material including the steps of providing the apparatus, depositing the mixed-density material at the top of the incline, and collecting the at least partially separated materials at the bottom of the incline.

A material sorter including: a rigid inclined panel having a top surface, a top portion of the top surface, and an inclined centerline; a guide rail abutting the top surface and coupled to the rigid inclined panel at an angle to the center line that is not parallel to the center line; and where a load of mixed-density material dumped on the top portion of the inclined plane will move downward to at least partially impact the guide rail, thereby changing a first downward path of lower density material of such mixed-density material differently than a second downward path of higher-density material of such mixed-density material, to assist in sorting the load of mixed-density material. The material sorter, where the guide rail includes a rotationally coupled guide rail, able to rotate slidingly on the top surface of the rigid inclined panel. The material sorter, further including a first actuator able to rotate the rotationally coupled guide rail. The material sorter, where the rotationally coupled guide rail and the rigid inclined panel are configured to support the rotationally coupled guide rail at two or more discrete rotational angles. The material sorter, where the guide rail includes first and second guide rails coupled together at respective first and second first ends to form an angled pair having an angle between the first and second guide rails and an apex pointing towards the top portion of the top surface of the rigid inclined panel. The material sorter, further including a second actuator able to rotate the first and second rotationally coupled guide rails to change the angle. The material sorter, where the guide rail includes third and fourth guide rails coupled near opposing sides of the rigid inclined panel and angled with first and second lower ends of such third and fourth guide rails, respectively, closer to the centerline than first and second upper ends of such third and forth guide rails, respectively. The material sorter, where the third and fourth guide rails comprise third and fourth guide rails rotationally coupled to the rigid inclined panel, able to rotate slidingly on the top surface of the rigid inclined panel. The material sorter, further including a third actuator able to rotate the third and fourth rotationally coupled guide rails. The material sorter, where the guide rail includes: a set of first and second guide rails coupled together at respective first and second first ends to form an angled pair having an angle between the first and second guide rails and an apex pointing towards the top portion of the rigid inclined panel, where the apex is near the centerline; a set of third and fourth guide rails coupled to the rigid inclined panel near opposing sides of the rigid inclined panel and angled with first and second lower ends of such third and fourth guide rails, respectively, closer to the centerline than first and second upper ends of such third and fourth guide rails, respectively. The material sorter, where the set of first and second guide rails coupled together includes a set of first and second guide rails rotationally coupled together. The material sorter, further including a third actuator able to rotate the first and second rotationally coupled guide rails to change the angle. The material sorter, where the set of third and fourth guide rails includes third and fourth rotationally coupled guide rails, able to rotate slidingly on the top surface of the rigid inclined panel. The material sorter, further including a first actuator able to rotate the third and fourth rotationally coupled guide rails.

A material sorter including: a rigid inclined panel having, a top surface, a top portion of the top surface, and an inclined centerline; one or more first guide rails abutting the top surface and coupled to the rigid inclined panel at a first angle to the center line that is not parallel to the center line; one or more second guide rails abutting the top surface and coupled to the rigid inclined panel at a second angle to the center line that is not parallel to the center line; and where a load of a mixed-density material dumped on the top portion of the inclined plane will move downward to at least partially impact the guide rail, thereby changing a first downward path of lower density material of such a mixed-density material differently than a second downward path of higher-density material of such a mixed-density material, to assist in sorting the load of mixed-density material. The material sorter, including a plurality of material sorters each having a corresponding plurality of different and distinct configurations of the first guide rail and the second guide rail, where each distinct configuration is adapted for assisting in sorting a correspondingly distinct mixed-density material. The material sorter, where the one or more first guide rails and/or the one or more second guide rails includes a rotational coupling to the rigid inclined plane; and further including an actuator for rotating each first guide rail and/or each second guide rail. The material sorter, where the first guide rail and/or the second guide rail includes a rotational coupling to the rigid inclined plane. The material sorter, further including one or more actuators for rotating one or more first guide rails and/or one or more second guide rails.

A material sorter including: a rigid inclined panel having, a top surface, a top portion of the top surface, and an inclined centerline; a first guide rail abutting the top surface and coupled to the rigid inclined panel at a first angle to the center line that is not parallel to the center line; a second guide rail abutting the top surface and coupled to the rigid inclined panel at a second angle to the center line that is not parallel to the center line; one or more actuators coupled to the rigid inclined panel and to one or more first guide rails and/or one or more second guide rail; and where a load of a mixed-density material dumped on the top portion of the inclined plane will move downward to at least partially impact the guide rail, thereby changing a first downward path of lower density material of such a mixed-density material differently than a second downward path of higher-density material of such a mixed-density material, to assist in sorting the load of the mixed-density material.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Figure 1:
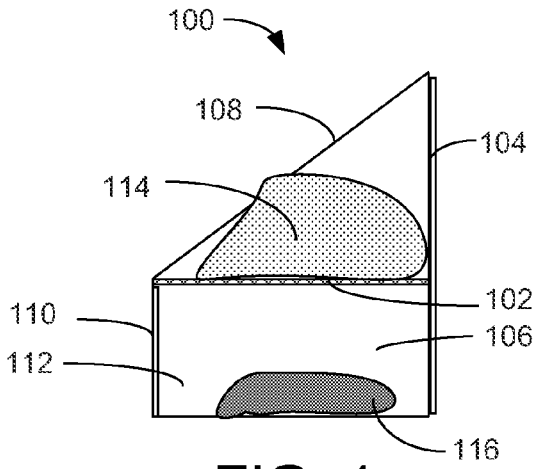
FIG. 1 PRIOR ART
FIG. 1 is a side view illustrating a prior art screening device.

FIG. 1 is a side view illustrating a prior art screening device 100. Debris 114 is deposited and moved on perforated screen 102 and small material 116 accumulates below screen 102. Screen 102 is supported horizontally by front wall 110 and side walls 110 (one visible in this view). Backstop 104 prevents material 114 from spilling over the back and sloped side walls 108 (one visible in this view) contain the material against lateral spillage. Access to the small material is though rear opening 106. Prior art screening device 100 is shown as a support for the material sorter 300 (See FIG. 3). Various businesses that would use material sorter 300 would already have prior art screening device 100, making a material sorter 300 that is adapted to be mounted on such prior art screening device 100 particularly inexpensive. In various embodiments, various support structures 100 can be used.

Figure 2:
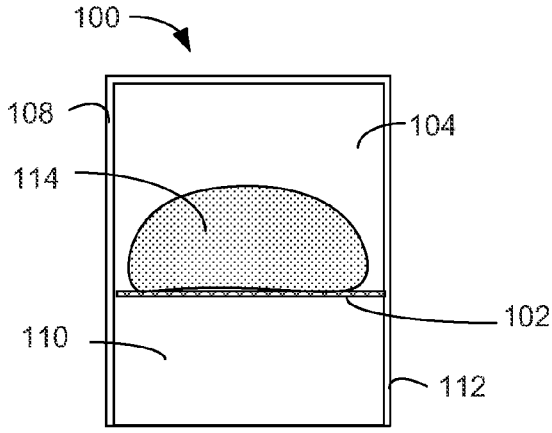
FIG. 2 PRIOR ART
FIG. 2 is a front view illustrating the prior art screening device of FIG. 1.

FIG. 2 is a front view illustrating the prior art screening device 100 of FIG. 1.

Figure 3:
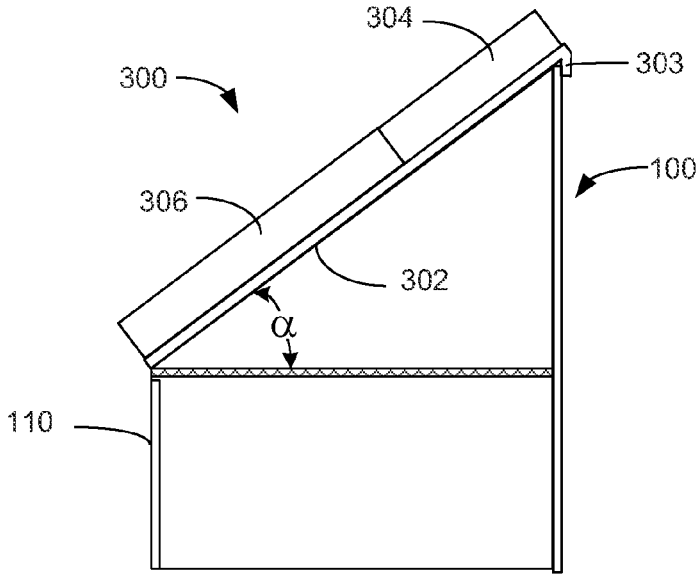
FIG. 3 is a side view illustrating an exemplary material sorter mounted on a prior art screening device, according to a preferred embodiment of the present invention.

FIG. 3 is a side view illustrating an exemplary material sorter 300 mounted on a prior art screening device 100, according to a preferred embodiment of the present invention. Material sorter 300 includes rigid panel 302, which is preferably a steel panel 302, or steel plate 302, but, in alternate embodiments may be made of other rigid materials. In operation, rigid panel 302 is inclined at an angle $\alpha$. Rigid panel 302 is preferably ten to fourteen feet wide and sits, on its front edge, above a front wall 110 that is preferably three to six feet high. Inclined rigid panel 302 may have a lip 303 to assist in securing inclined rigid panel 302 to prior art screening device 100. Lip 303 is an example of adaptations to inclined rigid panel 302 that assist in mounting the material sorter 300 to the prior art screening device 100. Prior art screening device 100 is merely an example of a means for supporting material sorter 300. Those of skill in the art, enlightened by the present disclosure, will be aware of various structures that can support the material sorter 300, and of various adaptations to the rigid panel 302 that can be made to help install the material sorter 300 on such structures. In a preferred embodiment, the inclination angle α may be varied mechanically, hydraulically, manually, or by similarly affective means.

Converging guide rail 304 is attached, or coupled, to rigid panel 302. Diverging guide rail 306 is also attached, or coupled, to rigid panel 302. Guide rails 304 and 306 are preferably one to three feet high, and should be shorter than the height dimension of the higher density material in the mixed-density material to be sorted. In a particular embodiment, guide rails 304 and 306 may be outside the preferred range. Material sorter 300 is shown at an incline angle α of forty-five degrees, but angles α between thirty and seventy five degrees are in the preferred range, depending on the materials to be sorted. For sorting cardboard from construction debris, for example, an incline angle α of thirty-two degrees has produced the best results in testing. In a particular embodiment, the incline angle α may be variable and actuated by manual, mechanical, motorized, or hydraulic means. Preferably, the entire apparatus is less than twelve feet high.

Figure 4:
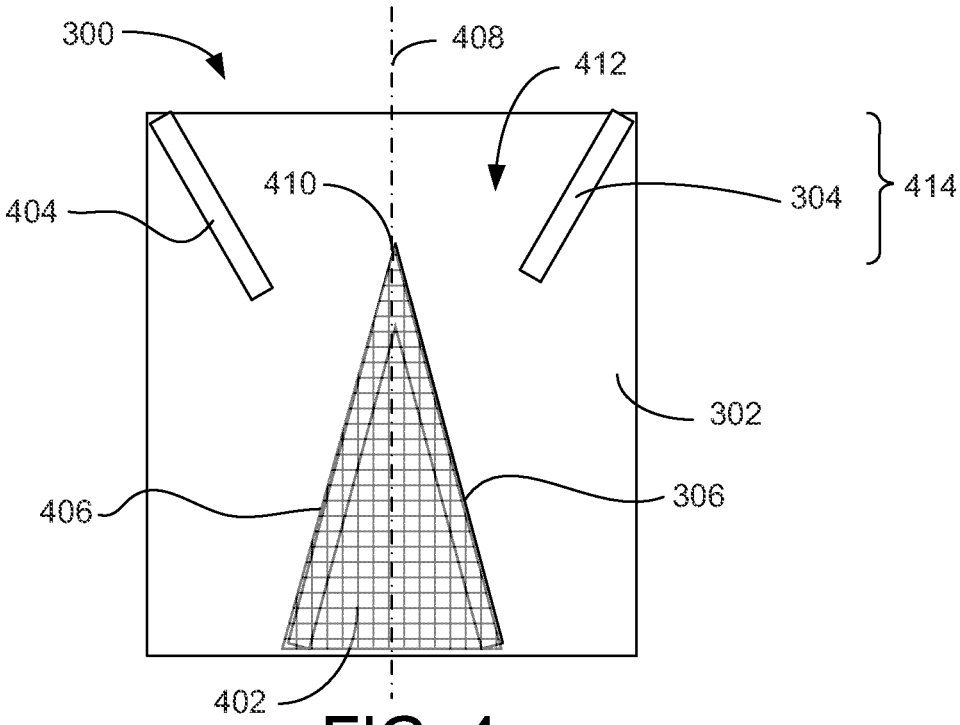
FIG. 4 is a view normal to an exemplary panel of the exemplary sorter of FIG. 3, according to a preferred embodiment of the present invention.

FIG. 4 is a view normal (perpendicular) to an exemplary panel 302 of the exemplary sorter 300 of FIG. 3, according to a preferred embodiment of the present invention. Inclined rigid panel 302 has a top surface 412 and a top portion 414 of that top surface, which is the area where the multi-density material to be sorted is deposited during operation. Inclined rigid panel 302 has a centerline 408, which shares the same inclination α as the inclined rigid panel 302. While inclined rigid panel 302 is illustrated as being generally rectangular, the invention is not so limited. The shape may be adapted to facility requirements.

Diverging guide rails 306 and 406 are covered by rigid panel 402 and form an apex 410 which points toward the top portion 414 and is on or near the inclined centerline 408. In a particular embodiment, rigid panel 402 may be omitted. Converging guide rails 304 and 404 direct the mixed-density material to be sorted in its gravity-powered travel down the inclined rigid panel 302 into diverging guide rails 306 and 406, slowing low density materials more than high density ones, and causing the light weight (low density) materials to move along a more outward path while the heavy (high density) materials hill more directly, thereby separating the materials on the floor in front of the material sorter 300. Guide rails 304, 306, 404, and 406 are shown as straight, but may, in various embodiments, be curved or angular. The height of guide rails 304, 306, 404, and 406 is not limited to constant heights. Converging guide rails 404 and 304 are positioned at a first angle to centerline 408. (See FIG. 9). Diverging guide rails 306 and 406 make a second angle to centerline 408, and form an angled pair of guide rails 306 and 406.

Figure 5:
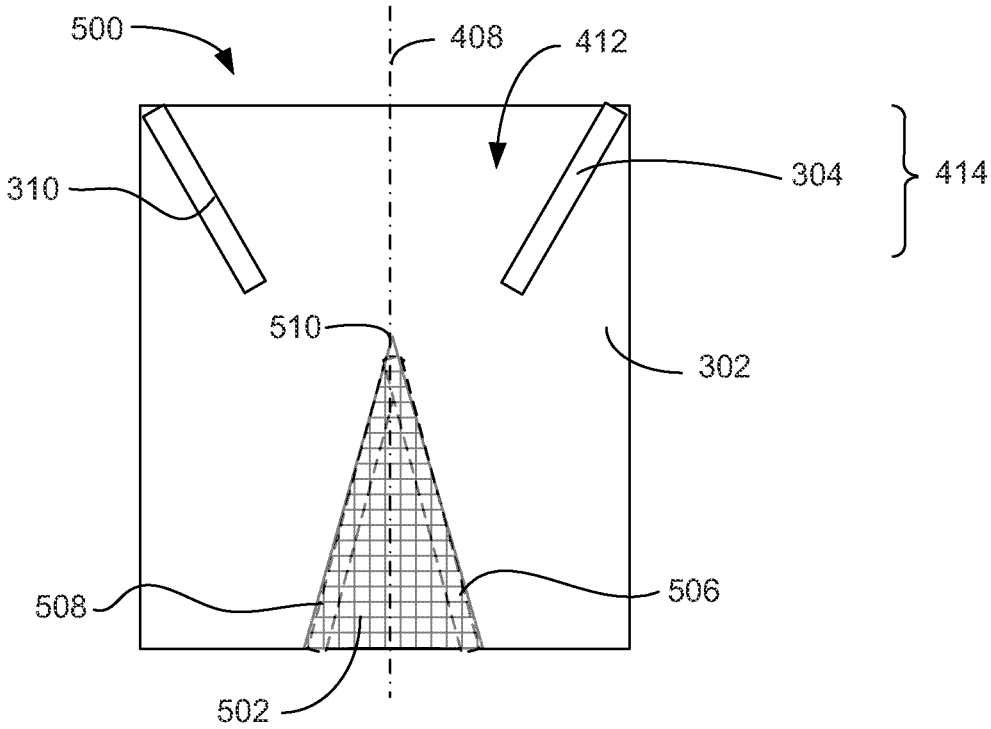
FIG. 5 is a view normal to an exemplary panel of an alternate exemplary embodiment of a material sorter, according to a preferred embodiment of the present invention.

FIG. 5 is a view normal (perpendicular) to an exemplary panel 302 of an alternate exemplary embodiment of a material sorter 500, according to a preferred embodiment of the present invention. Diverging guide rails 506 and 508 are smaller in this embodiment, as is covering panel 502. Apex 510 of angled pair 306 and 406 is lower than apex 410. Material sorter 500 is preferred for dryer materials than that used with material sorter 300. While diverging rails 506 and 508 are shown with the apex 510 centered, the apex 510 for 410) may be off center in some embodiments.

Figure 6:
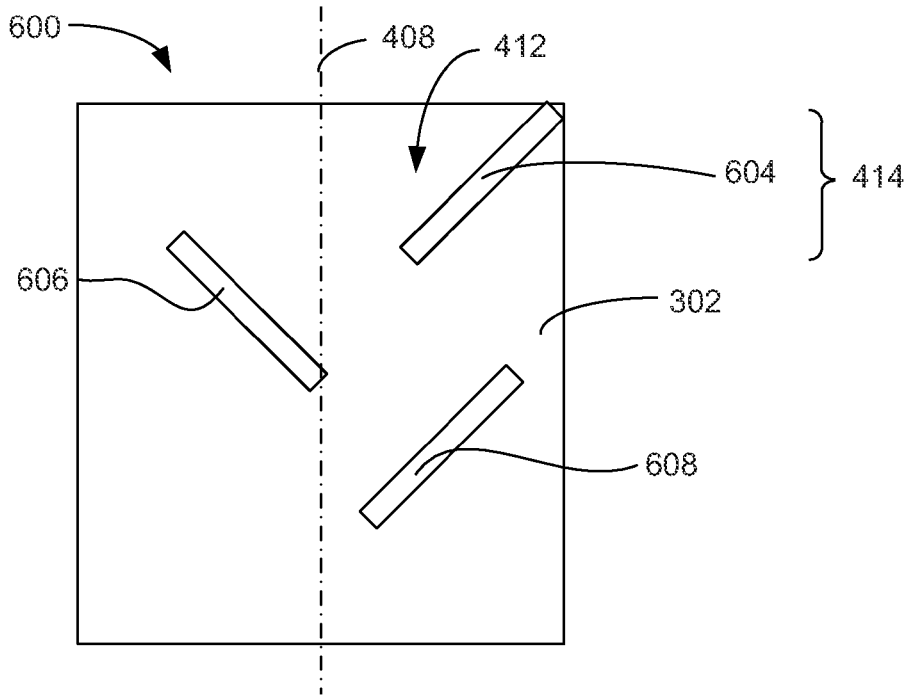
FIG. 6 is a view normal to an exemplary panel of another alternate exemplary embodiment of a material sorter, according to a preferred embodiment of the present invention.

FIG. 6 is a view normal to an exemplary panel 302 of another alternate exemplary embodiment of a material sorter 600, according to a preferred embodiment of the present invention. Guide rails 604, 606, and 608, decelerate the downwardly flowing debris but retard the lightweight materials more than the denser materials, thereby achieving separation. In various embodiments, the angles at which guiderails 604, 606, and 608 hae to centerline 408 may vary from that shown, or may be variable (in unison or individually) by mechanical, including hydraulic, or manual means. Different types of mixed-density material are best sorted by correspondingly different angles, which may be determined by simple experimentation.

Figure 7:
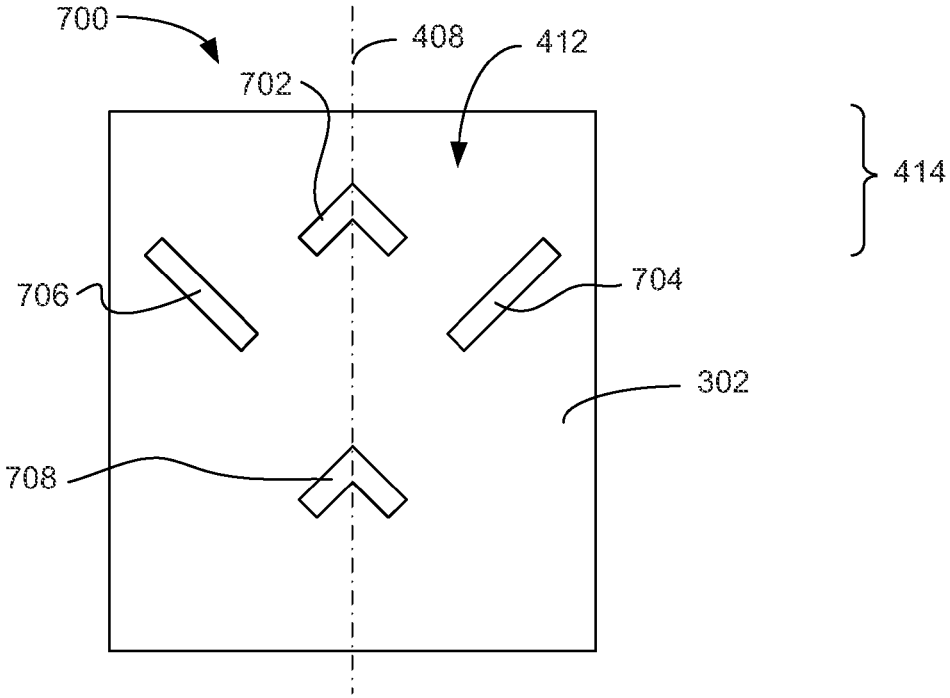
FIG. 7 is a view normal to an exemplary panel of yet another alternate exemplary embodiment of a material sorter, according to a preferred embodiment of the present invention.

FIG. 7 is a view normal to an exemplary panel 302 of yet another alternate exemplary embodiment of a material sorter 700, according to a preferred embodiment of the present invention. Guide rail 702 separates the flow of debris into two streams and guides both into converging guide rails 704 and 706, which direct the flow into diverging guide rail 708. Adaptive to various mixed-density materials, the sizes and positions of diverging guide rails 702 and 708, and the angles and lengths of converging guide rails 704 and 708, may vary.

Figure 8:
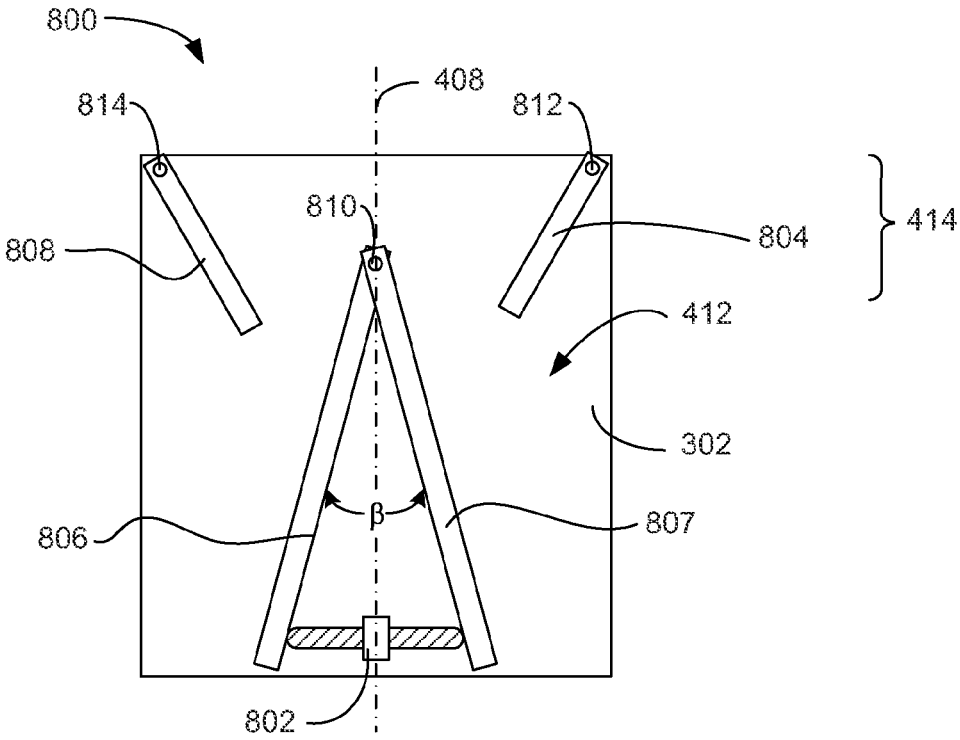
FIG. 8 is a view normal to an exemplary panel of still yet another alternate exemplary embodiment of a material sorter, according to a preferred embodiment of the present invention.

FIG. 8 is a view normal (perpendicular) to an exemplary panel 302 of still yet another alternate exemplary embodiment of a material sorter 800, according to a preferred embodiment of the present invention. The converging guide rails 804 and 808 have pivots 812 and 814, respectively, and actuators (not shown) to adjust the angle at which converging guide rails 804 and 808 operate. Converging guide rails 804 and 808 rotate slidingly on the top surface 412 of inclined rigid panel 302. Actuator 802 moves diverging guide rails 806 and 807 about pivot 810. Guide rails 804 and 808 may be releasably fixed at two or more discrete rotational angles by releasable mechanical connection to the inclined rigid panel 302. For example, captive pins (not shown) on the guiderails 804 and 808 may be received in aligned holes (not shown) in the inclined rigid panel 302.

Diverging guide rails 806 and 807 rotate slidingly on the top surface 412 of inclined rigid panel 302. Diverging guide rails 806 and 807 are coupled together by pivot 810 to form an angled pair having angle β. Diverging guide rails 806 and 807 may be covered with a two-piece cover, where one piece slides over another (not shown). In a particular embodiment, diverging guide rails 806 and 807 can be rotated separately by individual actuators. Guide rails 806 and 807 may be releasably fixed at two or more discrete rotational angles by releasable mechanical connection to the inclined rigid panel 302. For example, captive pins (not shown) on the guiderails 806 and 807 may be received in aligned holes (not shown) in the inclined rigid panel 302.

Figure 9:
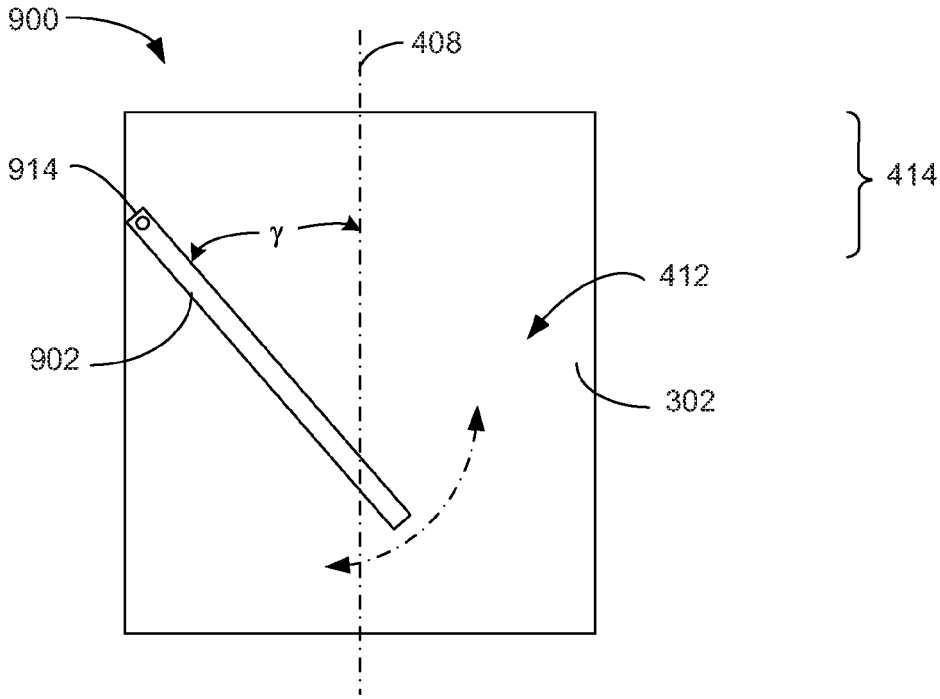
FIG. 9 is a view normal to an exemplary panel of still yet another alternate exemplary embodiment of a material sorter, according to a preferred embodiment of the present invention.

FIG. 9 is a view normal (perpendicular) to an exemplary panel 302 of still yet another alternate exemplary embodiment of a material sorter 900, according to a preferred embodiment of the present invention. Rotatable guide rail 902 can be rotated about pivot 914 by an actuator (not shown) to move slidingly over the top surface 414 of inclined rigid panel 302. Rotatable guiderail 902 makes an angle γ with inclined centerline 408. Guide rail 902 may be releasably fixed at two or more discrete rotational angles by releasable mechanical connection to the inclined rigid panel 302. For example, captive pins (not shown) on the guiderail 902 may be received in aligned holes (not shown) in the inclined rigid panel 302. In a mechanically actuated embodiment, guiderail 902 may also be used to sweep debris off panel 302.

Figure 10:
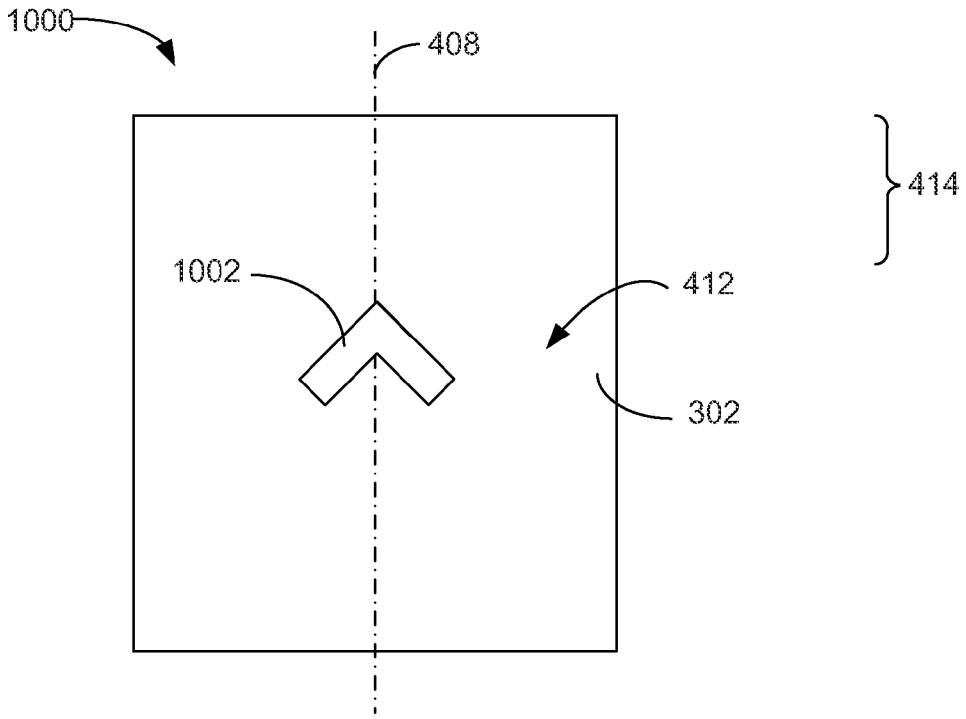
FIG. 10 is a view normal to an exemplary panel of still yet another alternate exemplary embodiment of a material sorter, according to a preferred embodiment of the present invention.

FIG. 10 is a view normal (perpendicular) to an exemplary panel 302 of still yet another alternate exemplary embodiment of a material sorter 1000, according to a preferred embodiment of the present invention. Diverging guiderail 1002, which may be regarded as an angled pair, deflects low-density material to the outside while the high-density material falls over the diverging guide rail 1002. Various diverging guiderails 1002 may be used in various embodiments.

Figure 11:
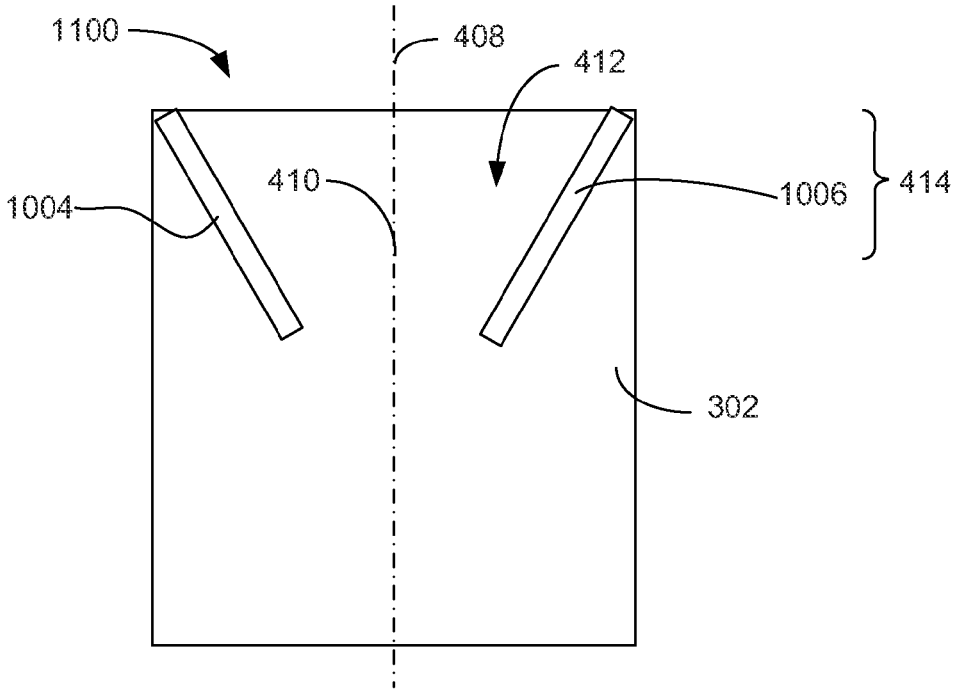
FIG. 11 is a view normal to an exemplary panel of still yet another alternate exemplary embodiment of a material sorter, according to a preferred embodiment of the present invention.

FIG. 11 is a view normal (perpendicular) to an exemplary panel 302 of still yet another alternate exemplary embodiment of a material sorter 1100, according to a preferred embodiment of the present invention. Converging guide rails 1004 and 1006 may be, in a particular embodiment, pivoted and/or mechanically actuated.

Figure 12:
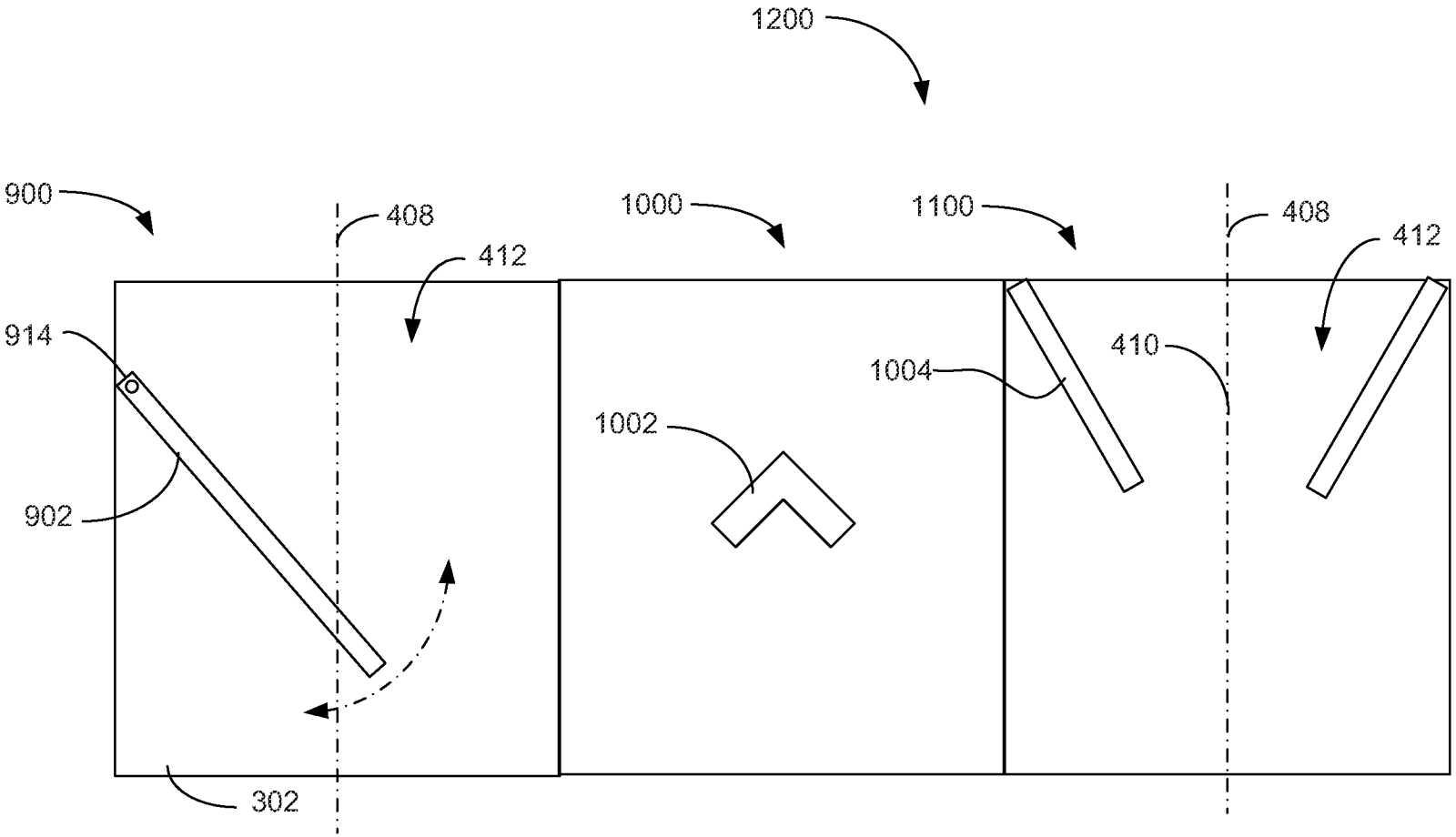
FIG. 12 is a view normal to an exemplary panel of a plurality of alternate exemplary embodiments of a material sorter, according to a preferred embodiment of the present invention.

FIG. 12 is a view normal (perpendicular) to an exemplary panel 302 of a plurality 1200 of alternate exemplary embodiments of a material sorter 900, 1000, and 1100, according to a preferred embodiment of the present invention. Any number of embodiments may be used together in an arrangement, such as the linear array shown, wherein each material sorter is configured for sorting a particular mixed-density material, and the loader may select the configuration appropriate to the load that has arrived for sorting. In combination with the embodiments shown, any or all other embodiments may be used in an arrangement. While a linear array is illustrated, any arrangement that is convenient in the sorting facility is within the scope of the present invention.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention.

I claim:

1. A material sorter comprising:

a. a rigid inclined panel having a top surface, a top portion of said top surface, and an inclined centerline;

b. at least one guide rail abutting said top surface and coupled to said rigid inclined panel at an angle to said center line that is not parallel to said center line;

c. wherein a load of mixed-density material dumped on said top portion of said inclined plane will move downward to at least partially impact said at least one guide rail, thereby changing a first downward path of lower density material of such mixed-density material differently than a second downward path of higher-density material of such mixed-density material, to assist in sorting such load of mixed-density material; and d. wherein said at least one guide rail comprises at least one rotationally coupled guide rail, operable to rotate slidingly on said top surface of said rigid inclined panel.

2. The material sorter of claim 1, wherein said at least one rotationally coupled guide rail comprises at least one releasably fixable guide rail on said top surface of said rigid inclined panel.

3. The material sorter of claim 1, further comprising at least one first actuator operable to rotate said at least one rotationally coupled guide rail.

4. The material sorter of claim 1, wherein said at least one rotationally coupled guide rail and said rigid inclined panel are configured to support said at least one rotationally coupled guide rail at at least two discrete rotational angles.

5. The material sorter of claim 1, wherein said at least one guide rail comprises first and second guide rails coupled together at respective first and second first ends to form an angled pair having an angle between said first and second guide rails and an apex pointing towards said top portion of said top surface of said rigid inclined panel.

6. The material sorter of claim 5, wherein said first and second guide rails comprise rotationally coupled first and second guide rails further comprising at least one second actuator operable to rotate said first and second rotationally coupled first and second guide rails to change said angle.

7. The material sorter of claim 1, wherein said at least one guide rail comprises third and fourth guide rails coupled proximate opposing sides of said rigid inclined panel and angled with first and second lower ends of such third and fourth guide rails, respectively, closer to said centerline than first and second upper ends of such third and forth guide rails, respectively.

8. The material sorter of claim 7, wherein said third and fourth guide rails comprise third and fourth guide rails rotationally coupled to said rigid inclined panel, operable to rotate slidingly on said top surface of said rigid inclined panel.

9. The material sorter of claim 8, further comprising at least one third actuator operable to rotate said third and fourth rotationally coupled guide rails.

10. The material sorter of claim 1, wherein said at least one guide rail comprises:

a. at least one set of first and second guide rails coupled together at respective first and second first ends to form an angled pair having an angle between said first and second guide rails and an apex pointing towards said top portion of said rigid inclined panel, wherein said apex is proximate said centerline;

b. at least one set of third and fourth guide rails coupled to said rigid inclined panel proximate opposing sides of said rigid inclined panel and angled with first and second lower ends of such third and fourth guide rails, respectively, closer to said centerline than first and second upper ends of such third and fourth guide rails, respectively.

11. The material sorter of claim 10, wherein said at least one set of first and second guide rails coupled together comprises at least one set of first and second guide rails rotationally coupled together.

12. The material sorter of claim 11, further comprising at least one third actuator operable to rotate said first and second rotationally coupled guide rails to change said angle.

13. The material sorter of claim 10, wherein said at least one set of third and fourth guide rails comprises third and fourth rotationally coupled guide rails, operable to rotate slidingly on said top surface of said rigid inclined panel.

14. The material sorter of claim 13, further comprising at least one first actuator operable to rotate said third and fourth rotationally coupled guide rails.

15. A material sorter comprising:

a. a rigid inclined panel having, a top surface, a top portion of said top surface, and an inclined centerline;

b. at least one first guide rail abutting said top surface and coupled to said rigid inclined panel at a first angle to said center line that is not parallel to said center line;

c. at least one second guide rail abutting said top surface and coupled to said rigid inclined panel at a second angle to said center line that is not parallel to said center line; and d. wherein a load of at least one mixed-density material dumped on said top portion of said inclined plane will move downward to at least partially impact said at least one guide rail, thereby changing a first downward path of lower density material of such at least one mixed-density material differently than a second downward path of higher-density material of such at least one mixed-density material, to assist in sorting such load of at least one mixed-density material; and e. wherein at least one of said at least one first guide rail and said at least one second guide rail comprises a rotational coupling to said rigid inclined plane.

16. The material sorter of claim 15, comprising a plurality of material sorters each having a corresponding plurality of different and distinct configurations of said at least one first guide rail and said at least one second guide rail, wherein each distinct configuration is adapted for assisting in sorting a correspondingly distinct such mixed-density material.

17. The material sorter of claim 16, a. wherein at least one of said at least one first guide rail and said at least one second guide rail comprises a rotational coupling to said rigid inclined plane; and b. further comprising at least one actuator for rotating said at least one of said at least one first guide rail and said at least one second guide rail.

18. The material sorter of claim 15, wherein at least one of said at least one first guide rail and said at least one second guide rail is releasably fixable to said rigid inclined plane.

19. The material sorter of claim 18, further comprising at least one actuator for rotating said at least one of said at least one first guide rail and said at least one second guide rail.

20. A material sorter comprising:

a. a rigid inclined panel having, a top surface, a top portion of said top surface, and an inclined centerline;

b. at least one first guide rail abutting said top surface and coupled to said rigid inclined panel at a first angle to said center line that is not parallel to said center line;

c. at least one second guide rail abutting said top surface and coupled to said rigid inclined panel at a second angle to said center line that is not parallel to said center line;

d. at least one actuator coupled to said rigid incline panel and to at least one of said at least one first guide rail and said at least one second guide rail; and e. wherein a load of at least one mixed-density material dumped on said top portion of said inclined plane will move downward to at least partially impact said at least one guide rail, thereby changing a first downward path of lower density material of such at least one mixed-density material differently than a second downward path of higher-density material of such at least one mixed-density material, to assist in sorting such load of at least one mixed-density material.

* * * * *